United States Patent [19]

Smith et al.

[11] Patent Number: 4,462,582

[45] Date of Patent: Jul. 31, 1984

[54] HANDLE CONTROL APPARATUS FOR CLOTH SPREADING MACHINE

[75] Inventors: Hoyt L. Smith; D. Frank Farrar, Jr., both of Nashville, Tenn.

[73] Assignee: Cutters Exchange, Inc., Nashville, Tenn.

[21] Appl. No.: 406,316

[22] Filed: Aug. 9, 1982

[51] Int. Cl.[3] ..... B65H 29/46

[52] U.S. Cl. ..... 270/31; 200/61.44

[58] Field of Search ..... 270/30–31; 200/52 R, 61.44, 61.54

[56] References Cited

U.S. PATENT DOCUMENTS

| | | | |
|---|---|---|---|
| 3,400,927 | 9/1968 | Martin, Sr. et al. | 270/31 |
| 3,540,720 | 11/1970 | Merrill | 270/31 |
| 3,713,642 | 1/1973 | Paterson | 270/31 |
| 3,735,223 | 5/1973 | Fort et al. | 270/30 |
| 3,811,669 | 5/1974 | Benson et al. | 270/31 |
| 4,082,258 | 4/1978 | Smith | 270/31 |
| 4,380,330 | 4/1983 | Smith et al. | 270/31 |

FOREIGN PATENT DOCUMENTS

| | | | |
|---|---|---|---|
| 2339161 | 8/1973 | Fed. Rep. of Germany | 270/31 |

*Primary Examiner*—E. H. Eickholt

*Attorney, Agent, or Firm*—Harrington A. Lackey

[57] ABSTRACT

A motor-driven cloth spreading machine having a rotary and longitudinally shiftable elongated control shaft for controlling the speed, direction, and braking of the motor driving the cloth spreading machine. The rotary movement of the control shaft is adapted to vary the speed and control the braking means for the motor, while the longitudinal shiftable movement of the control shaft actuates directional switches for controlling the direction of the machine movement.

8 Claims, 6 Drawing Figures

AC1
AC2

HANDLE CONTROL APPARATUS FOR CLOTH SPREADING MACHINE

BACKGROUND OF THE INVENTION

This invention relates to a cloth spreading machine, and more particularly to a manually operated drive control apparatus for a cloth spreading machine.

Drive speed control apparatus for cloth spreading machines are known in the art, such as those disclosed in the U.S. Merrill Pat. No. 3,540,720, issued Nov. 17, 1970, the Paterson U.S. Pat. No. 3,713,642, issued on Jan. 30, 1973, and the Smith U.S. Pat. No. 4,082,258, issued Apr. 4, 1978.

All of the above patents disclose cloth spreading machines driven by electrical motors controlled by rheostats or powerstats, which are actuated by manual control mechanisms of different types. These manual control mechanisms are designed to permit an operator walking alongside the moving cloth spreading machine to control the speed of the machine by manipulating a handle, which is linked to means for varying the electrical resistance in a rheostat or potentiometer.

Both the Merrill and Paterson patents include an elongated rigid link bar as a means for connecting the handle member to the wiper of the electrical rheostat.

The Smith patent discloses an elongated control shaft, having radial handles at opposite ends thereof, which is rotatably mounted along the side of the machine, and is provided with link means to a rotary pontentiometer or "Powerstat," so that the rotation of the control shaft by the handle at either end will vary the speed of the motor and therefore the speed of the cloth spreading machine.

Only the Paterson patent discloses a manually operable switch 81 for reversing the direction of the electric motor, and thereby the direction of movement of the cloth spreading machine. However, this reversing switch forms no part of the operating handle mechanism which controls the speed of the motor.

Both the handle members disclosed in the Merrill and Paterson patents are difficult to manipulate, because they require an exceptional amount of strength in the hand or wrist of the operator, and incorporates a minimal mechanical advantage between the handle member and the wiper of the rheostat.

None of the Merrill, Paterson, or Smith patents disclose the combination of a speed control actuator and directional control actuators, much less a brake control actuator, assembled on an elongated handle member capable of being longitudinally shifted and rotated about its own longitudinal axis.

SUMMARY OF THE INVENTION

It is therefore an object of this invention to provide a cloth spreading machine incorporating a manually operated drive control, which is responsive to hand manipulation by the operator to control, not only the speed of the machine, but also the direction of movement of the machine and the stopping of the machine at any position of the machine along its reciprocal course over the cloth spreading surface or cutting table.

Specifically, the control apparatus includes an elongated control shaft having radial handles at its opposite ends, the control shaft being mounted along one side of the frame of the machine in such a manner that it may be manually rotated or longitudinally shifted in either longitudinal direction by the operator walking beside the machine. The longitudinal shifting of the control shaft in one direction causes the machine to move in the same longitudinal direction through a first directional switch means, while longitudinal movement of the control shaft in the opposite direction causes the machine to move in that same opposite direction through actuation of a second directional switch means.

Both the speed and the braking of the machine are controlled by rotary movement of the control shaft. The speed of the machine is controlled by a rotary potentiometer coupled to a gear concentrically mounted on the control shaft for varying the speed of the electric motor. The braking is controlled by a brake mechanism actuated by a brake switch which is engaged by a brake arm radially mounted on the control shaft when the control shaft is rotated to a stop position. The brake switch is also operatively connected to the drive circuit for the motor to de-actuate the directional switches and the speed control of the motor when the brake switch is actuated in stop position.

The brake switch and the directional switches are also connected in electrical circuitry with the existing plunger-actuated automatic reversing switches at opposite ends of the cloth spreading machine. The reversing switches are normally actuated to override the corresponding first and second directional switches when the plungers engage a fixed stop mechanism at a corresponding end of the cutting table.

DESCRIPTION OF THE PREFERRED EMBODIMENTS

Figures 1, 2, 3, 4, 5, 6:
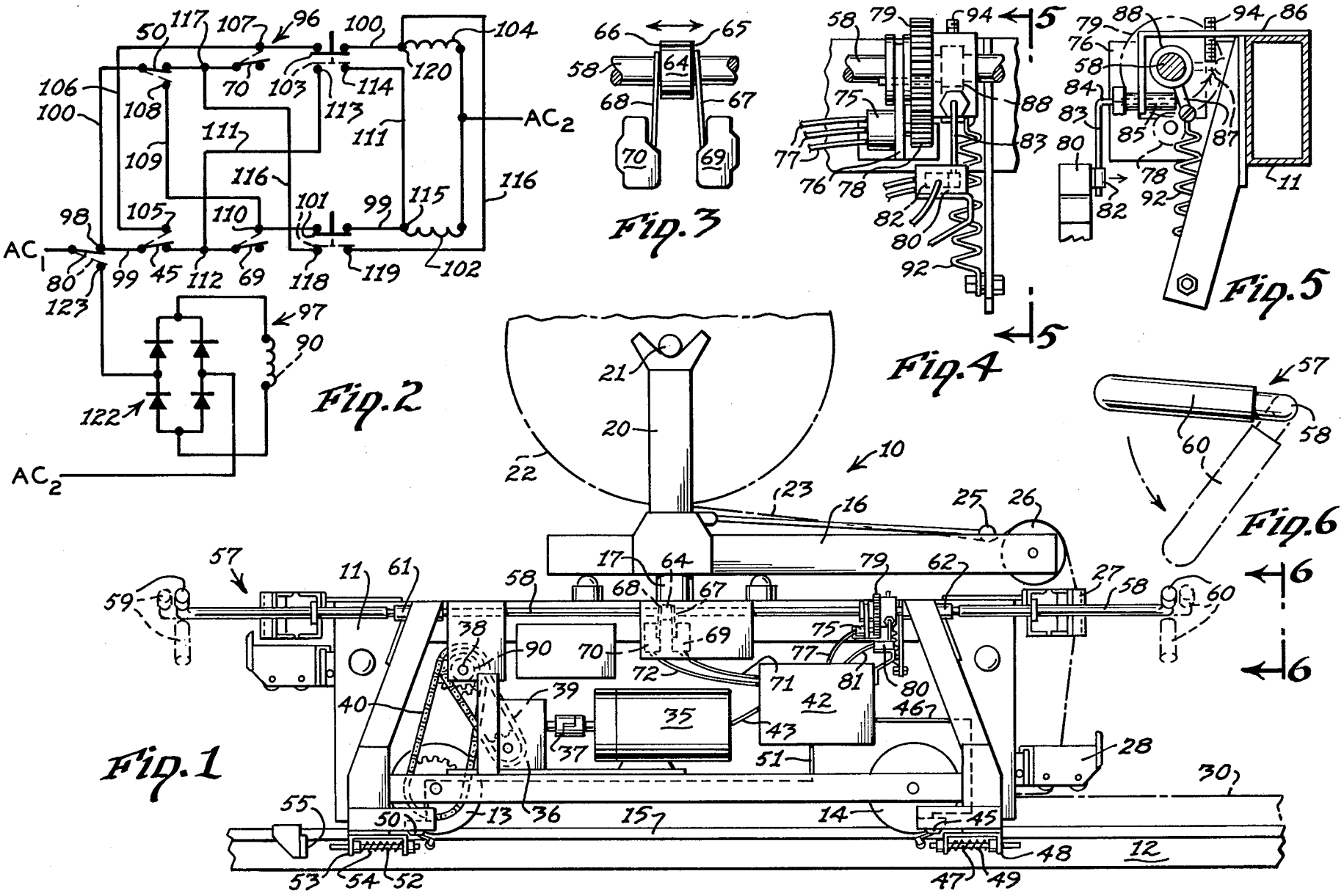
FIG. 1 is a side elevation of the cloth spreading machine incorporating the manual drive control apparatus made in accordance with this invention, taken from the operator's side of the machine.
FIG. 2 is a schematic electrical circuit diagram of the drive control apparatus made in accordance with this invention.
FIG. 3 is an enlarged, fragmentary side elevational view of the actuator mechanism for the directional switches.
FIG. 4 is an enlarged fragmentary side elevational view of the speed control and brake actuator mechanisms.
FIG. 5 is a sectional view, taken along the line 5—5 of FIG. 4.
FIG. 6 is an enlarged end view of the control shaft handle, taken along the line 6—6 of FIG. 1.

Referring now to the drawings in more detail, the cloth spreading machine 10 made in accordance with this invention includes a frame, or machine frame, 11 supported by smooth-surfaced wheels, not shown, on the remote side of the frame 11 for rolling movement over the top surface of a spreading or cutting table 12. The proximal or operator side of the machine 10 is supported by the grooved wheels 13 and 14 for movement along a track or rail 15 fixed alongside the cutting table 12, in a conventional manner.

Mounted on top of the machine frame 11 is a cloth supply carriage 16 in the form of a turntable mounted for rotary movement about the vertical axis of the shaft 17.

Mounted at opposite sides of the cloth supply carriage 16 are a pair of cloth roll support standards 20, only one of the pair at one end of the carriage 16 being visible in FIG. 1. The pair of standards 20 support a spindle 21 upon which is wound a cloth supply roll 22.

From the cloth supply roll 22 a web of cloth 23 passes beneath a transverse guide bar 25, over a cloth feed roll 26 mounted on one end of the carriage 16, and then down through an edge sensor 27 and through a conventional spreader unit 28. The spreader unit 28 spreads or lays the web 23 upon the surface of the table 12 in layers 30, as the machine frame 11 reciprocates longitudinally on a predetermined course over the cutting table 12, from one end of the spread layers to the other.

As best disclosed in FIG. 1, a motor 35 mounted on the machine frame 11 drives a gear reducer 36, through shaft coupling 37. The gear reducer 36 drives the wheel drive shaft 38 through sprocket and chain transmission 39. Power from the wheel drive shaft 38 is transmitted to the wheel 13 through sprocket and chain transmission 40. Control circuitry for the motor 35 is mounted in the control housing 42 on the machine frame 10. The circuitry in the control housing 42 is connected to the electrical motor 35 through the cable 43.

Mounted at the lower front end portion of the frame 11 is a front reversing switch or microswitch 45 which is electrically connected through the cable 46 to the control circuitry in the housing 42. The front reversing switch 45 is adapted to be actuated by the front plunger 47 during its rearward movement relative to the reversing switch 45. The plunger 47 is reciprocally carried in the plunger bracket 48 and is biased by the spring 49 normally to its forward position.

In a similar manner, the rear reversing switch or microswitch 50 is electrically connected to the circuitry within the control housing 42 through the cable 51. The rear reversing switch 50 is adapted to be actuated upon the relative forward movement of the rear plunger 52 slidably and reciprocally carried in the rear plunger bracket 53. A spring 54 normally biases the plunger 52 to its rearward position.

When the machine 10 is moving rearward, or toward the left in FIG. 1, and approaches the left end of its course, the plunger 52 engages a stop member 55 fixed to the track 15, causing the plunger 52 to stop as the machine 10 continues to move rearward. This produces a relative forward movement between the plunger 52 and the rear reversing switch 50 causing the plunger 52 to actuate the reversing switch 50, to reverse the direction of the motor 35, and thereby the wheel 13, to change the movement of the machine 10 from rearward to forward, in a well known manner.

By the same token, when the machine 10 approaches the forward extremity of its course over the cutting table 12, the front plunger 47 engages a fixed front stop member, not shown, but identical to the rear stop member 55, causing the relative rearward movement between the plunger 47 and the bracket 48 to actuate the front reversing switch 45 and thereby change the direction of the motor 35, and consequently the machine movement from forward to rearward, in a well known manner.

The mechanism for controlling the operation of the electrical motor 35, and consequently the drive of the machine 10, in accordance with this invention, includes an elongated control handle member 57 including an elongated handle shaft 58 terminating in a pair of radially extending handles 59 and 60. The handle shaft 58 is mounted in bearings, such as 61 and 62, fixed to the machine frame 11, for both rotational and limited longitudinal movement of the shaft 58, as illustrated in FIG. 1.

The shaft 58 is provided with a directional switch actuator, such as the cylindrical actuator 64 which projects radially beyond the surface of the handle shaft 58 and is provided with the opposed front and rear actuating surfaces or faces 65 and 66. The switch actuator 64 is located between an opposing pair of front-to-rear spaced switch actuator fingers 67 and 68 of the front directional switch or microswitch 69 and the rear directional switch or microswitch 70, respectively. The directional switches 69 and 70 are connected to the circuitry within the housing 42 through the cables 71 and 72. The directional switches 69 and 70 and the switch actuator 64 are best disclosed in FIGS. 1 and 3.

When the handle shaft 58 is moved forward, or toward the right of FIG. 1, the actuator 64 will engage and deflect the front switch finger 67 until the front directional switch 69 is actuated to cause the electrical motor 35 to be driven in a forward direction, causing the wheel 13 to rotate clockwise in FIG. 1, to drive the machine 10 forward along the table 12. In like manner, when the handle shaft 58 is moved rearwardly, the actuator 64 will engage and deflect the switch finger 68 actuating the rear directional switch 70 to cause the machine 10 to be driven in a rearward direction. The spacing of the switch fingers 67 and 68 from the actuator 64 are such that only one directional switch 69 or 70 can be actuated at any one time, and when the actuator 74 is in its neutral position disclosed in FIG. 3, neither directional switch 69 nor 70 will be actuated.

Also, mounted upon the frame 11 adjacent the front of the machine 10, as illustrated in FIGS. 1 and 4, is a rotary potentiometer 75 supported on bracket 76 and connected by cable 77 to the circuitry within the control housing 42. The wiper mechanism, not shown, within the rotary potentiometer 75 terminates in a small pinion or spur gear 78 meshing with a larger spur gear 79 mounted concentrically upon the handle shaft 58 for rotary movement therewith. The large spur gear 79 is keyed to the handle shaft 58 so that the spur gear 79 will remain longitudinally stationary as the handle shaft 58 is moved longitudinally through the spur gear 79 in either longitudinal direction. However, as the handle shaft 58 is rotated, the spur gear 79 is simultaneously rotated to drive the small spur gear 78 and thereby change the electrical resistance within the rotary potentiometer 75. This change in electrical resistance within the potentiometer 75 causes the speed of the electrical motor 35 to change proportionately, and thereby proportionately vary the speed of the rotary movement of the wheel 13 and the longitudinal speed of the frame 11. Any other type of electrical control device which is capable of varying the voltage of the electrical motor 35, such as a "Powerstat" variable autotransformer, may be substituted for the rotary potentiometer 75.

Also, fixed to the frame 11 slightly forward of the rotary potentiometer 75 is a brake switch or brake microswitch 80 connected by cable 81 to the control circuitry within the housing 42. The switch finger 82 of the brake microswitch 80 is adapted to be engaged and laterally shifted by the radial arm 83 of a transversely reciprocal pin member 84 transversely slidable within a sleeve 85 fixed in a bracket 86 upon the frame 11. The opposite, or inner, free end of the pin member 84 is adapted to be engaged by a radially extending brake actuator arm 87 fixed by means, such as collar 88, to the elongated handle shaft 58. Thus, as illustrated in FIG. 5, when the handle shaft 58 is rotated clockwise, the actuator arm 87 is also rotated clockwise to engage the free inner end of the pin member 84, causing it to move transversely to the left of FIG. 5 to depress the switch finger 82 and actuate the brake switch 80, energizing the electromagnetic brake 90 on the wheel drive shaft 38 (FIG. 1) to cause the machine 10 to stop. When the handle shaft 58 is rotated counterclockwise, the actuator pin 84 is moved to the right of FIG. 5 by the inherent spring action of the switch finger 82, to de-actuate the brake microswitch 80, thereby de-energizing the electromagnetic brake 90.

So that the brake actuator switch 80 will always be actuated to stop the machine 10 when the handle member 57 is released, a coil spring 92 connects the actuator arm 87 to the frame 11 so that the actuator arm 87 is always down in its solid-line position of FIG. 5 to force the actuator pin 84 to the left causing the switch finger 82 to remain in a depressed position for actuating the brake microswitch 80.

The bracket 86 is also provided with an adjustable threaded stop pin 94 to limit the rotary movement of the actuator arm 87 and the rotary movement of the handle shaft 58 to limit the maximum speed of the machine 10. The threaded stop pin 94 may be adjusted up or down to change the maximum speed limit of the machine 10.

FIG. 2 discloses a schematic diagram of the electrical directional circuit 96 and the brake circuit 97, each of which is connected across the power lines $AC_1$ and $AC_2$.

The directional circuit 96 includes the supply contact 98 adapted to be selectively engaged by the brake switch 80. Connected to the supply contact 98 in parallel are the front and rear directional circuits 99 and 100. The front directional circuit 99 includes the front automatic reversing switch 45, the front manual directional switch 69, rear interlock relay switch 101, and forward directional motor circuit relay coil 102.

The rear directional circuit 100 includes the rear automatic reversing switch 50, the rear manual directional switch 70, the front interlock relay switch 103, and the rear motor directional relay coil 104.

When the front automatic reversing switch 45 is in its dashed-line position (FIG. 2), it engages contact 105 connected to bypass circuit 106 which is connected to switch contact 107 for the rear directional switch 70 in its dashed-line position.

When the rear automatic reversing switch 50 is in its dashed-line position (FIG. 2), it engages the contact 108, which is connected to bypass circuit 109, which in turn is connected to contact 110 of the front directional switch 69 in its dashed-line position.

Interlock circuit 111 is connected to junction 112 in the front directional circuit 99 between the switches 45 and 69 and to contact 113 of the interlock relay switch 103 in its dashed-line position (FIG. 2). The other contact 114 of relay switch 103 is connected through the other side of the interlock circuit 111 to contact 115 of the front directional relay coil 102.

In like manner, interlock circuit 116 is connected to junction 117 between the switches 50 and 70 in the rear directional circuit 100 and through contacts 118 and 119 for the alternate, dashed-line position, of the rear interlock relay switch 101, to the contact 120 of the rear directional relay coil 104.

The electrical brake circuit 97 includes the electromagnetic brake coil 90 which is connected through the diode bridge 122 to the alternate brake switch contact 123.

For the purposes of describing the operation of the machine 10, it will be assumed that the machine 10 is stopped at some position along its course on the cutting table 12 between and away from the track stops, such as the track stop 55 and the front track stop, not shown. In this position, the handles 59 and 60 will be in their elevated solid-line positions, disclosed in FIGS. 1 and 6, in which positions the radial actuator arm 87 will be in its down, solid-line position illustrated in FIG. 5 for actuating the brake microswitch 80. When the brake microswitch 80 is actuated; it will be in its dashed-line position in FIG. 2, engaging the contact 123, thereby energizing the electromagnetic brake coil 90 to stop the machine 10. Of course, when the brake switch 80 is in its dashed-line position, the entire directional circuit 96 is cut off from its power source $AC_1$.

Now, if the machine operator desires to move the machine 10 in its rearward direction, that it is to the left of FIG. 1, he grasps the handle 60, pushes it longitudinally rearward, and simultaneously or subsequently rotates the handle 60 in a counterclockwise direction, as shown in FIG. 6, until the handle 60 is in the angular position corresponding to the desired speed of the machine 10. When the handle 60 is thrust rearward, the handle shaft 58 will also move rearward carrying the directional switch actuator 64 rearward to engage and depress the switch finger 68, thereby actuating the rear directional switch 70.

As the handle shaft 58 is rotated by the handle 60, the gears 79 and 78 are simultaneously counter-rotated to change the electrical resistance within the rotary potentiometer 75, which in turn varies the speed control within the housing 42 for the electrical motor 35.

When the rear directional switch 70 is actuated, it is moved to its dashed-line position disclosed in FIG. 2. The rear automatic reversing switch 50 remains in its inoperative solid-line position of FIG. 2, and the front inter-lock relay switch 103 will remain in its solid-line position. Since the handle 60 has been rotated away from its stop position, brake switch 80 is moved to its solid-line position in FIG. 2 to open the brake circuit 97 and close directional circuit 96. Therefore, power is supplied through the rear directional circuit 100 to the rear directional relay coil 104 to cause the machine 10 to move in its rearward direction at the speed determined by the rotary potentiometer 75.

If, during the rearward travel, the operator decides to stop the machine 10 before it reaches the end of the table, he merely counter-rotates the handle 60 to its solid-line position disclosed in FIGS. 1 and 6, which will cause the brake switch 80 to shift from its solid-line to its dashed-line position in FIG. 2, immediately energizing the electromagnetic brake 90 and removing power from any portion of the directional circuit 96. Accordingly, it is not necessary for the operator to longitudinally shift the handle 60 to its neutral position or any other position in order to de-energize the motor 35. The power to both motor directional coils 102 and 104 will automatically be removed when the brake switch 80 is shifted to its dashed-line position.

After the rear motor relay coil 104 is energized, it actuates the rear inter-lock relay switch 101 to its dashed-line position, disclosed in FIG. 2, so that the inter-lock switch relay switch 101 now functions as a holding relay and connects the closed interlock circuit 116 to the rear coil 104. Thus, the machine 10 will continue to move in its rearward direction, even if the rear directional switch 70 is no longer actuated. Therefore, it is only necessary for the operator to thrust the handle member 57 in a rearward direction to momentarily engage and actuate the rear reversing switch 70 in order to cause the machine 10 to move rearwardly. The operator's rearward thrust may then be relaxed, or the handle member 57 may even be retracted without interrupting the energization of the rear directional relay coil 104 and the rearward directional movement of the machine 10.

If the handle member 57 is inadvertently retracted too far so that it engages and actuates the front manual directional switch 69, causing it to move to its dashed-line position, disclosed in FIG. 2, no current will pass through the front directional switch 69 to the front coil 102, because the rear inter-lock switch 101 is in its dashed-line position, and thereby maintains the front directional circuit 99 to the coil 102 open, regardless of the position of the front directional switch 69.

If the machine 10 continues moving rearward until it reaches the extreme rear or left end of the table (FIG. 1), or the extreme rearward limit of its course, the plunger 52 engaging the stop 55 will actuate the rear reversing switch 50 momentarily, causing the switch 50 to move to its dashed-line position in FIG. 2, thereby removing power from the rear coil 104, both through the circuit 100 and the circuit 116. De-energization of the rear coil 104 will immediately cause the rear interlock switch 101 to return to its solid-line position in the circuit 99, thereby energizing the forward motor coil 102. In this mode, power is supplied through the circuit 100, the reversing switch 50 (in its dashed-line position), by-pass circuit 109, and the inter-lock switch 101 in its solid-line position. Energization of the forward relay coil 102 will cause the inter-lock relay switch 103 to drop from its solid-line to its dashed-line position in the inter-lock circuit 111, thereby functioning as a holding relay for the front coil 102. Thus, even after the machine 10 has reversed its direction from rearward to forward and the plunger 52 has disengaged its stop 55 to de-actuate the reversing switch 50, causing it to return to its solid-line position in FIG. 2, thereby opening the circuit 109, nevertheless the current is still supplied to the front coil 102 through the circuit 99 and inter-lock circuit 111 closed by the inter-lock switch 103 in its dashed-line position. Thus, the machine 10 will continue in its forward direction, even after the reversing switch 50 has been de-actuated. Furthermore, this forward direction will be continued and maintained, regardless of the position of the manual forward directional switch 69.

Therefore, it is only possible to reverse the direction of the machine 10 during its forward travel along the table 12 by first rotating either handle 60 or 59 to its elevated stop position to close the brake switch 80, which simultaneously actuates the electromagnetic brake 90 and removes all power from the directional circuit 96 to de-energize both coils 102 and 104.

After the machine is stopped, then the handle member 57 may be utilized to re-start the machine 10 in either direction, depending upon the longitudinal direction in which the handle member 57 is thrust for actuating the corresponding front or rear directional switch 69 or 70.

This manual reversing procedure is also true when the machine is running in its rearward direction. The machine 10 must first be stopped by rotating the handles 59 or 60 to its elevated stop position, to first stop the machine and take the power off of the directional circuit 96, before movement of the machine can be restored in either direction, depending upon the longitudinal directional movement of the handle member 57.

Moreover, it is apparent that the machine 10 will not start in either direction until the handle has been rotated away from its stop position, causing the brake microswitch 80 to shift from its dashed-line braking position to its solid-line power supply position in FIG. 2.

By virtue of the above controls, damage to the machine or its controls can be avoided in the event that the operator inadvertently retracts the longitudinal handle member 57 in a direction opposite to the direction in which the machine is moving.

It will also be noted from the circuitry disclosed in FIG. 2 that even if the machine is being operated fully automatically, that is under the control of the automatic reversing switches 45 and 50, the machine 10 cannot be moved in either direction unless the handle is rotated away from its stop position so that power can be supplied to the reversing switches 45 and 50, regardless of the positions of the reversing switches 45 and 50.

In effect, the circuitry disclosed in FIG. 2 provides a "dead man control" for the machine. If, for some reason, the operator's attention is diverted or he inadvertently removes his hand from either of the handles 59 or 60, the shaft 58 will be immediately rotated to its braking or stop position by the spring 92 to cause the machine to immediately stop and to cause both directional relay coils 102 and 104 to become de-energized.

Accordingly, the handle control mechanism for a cloth spreading machine made in accordance with this invention comprehensively incorporates means for manually controlling, not only the speed of the spreading machine, but also the selective control of the direction of the machine from any position along the table, in addition to the automatic reversing controls at the ends of the table, and a manually and automatically controlled braking mechanism.

What is claimed is:

1. In a cloth spreading machine having a frame supporting a spreading mechanism adapted to spread cloth upon a spreading surface as the frame moves longitudinally reciprocally over the spreading surface, handle control apparatus comprising:

(a) a motor operatively connected to said frame for driving said frame over said spreading surface;

(b) a speed control device operatively connected to said motor to vary the speed of said frame, (c) said speed control device having an operator element adapted to actuate said speed control device to vary the speed of said frame in response to the position of said operator element, (d) motor directional reversing means operatively connected to said motor for driving said frame in one longitudinal direction or the other, (e) an elongated control shaft having opposite end portions and an intermediate operator portion, (f) means mounting said control shaft on said frame for rotatable and longitudinal reciprocal movement relative to the longitudinal axis of said control shaft, (g) a handle member fixed to each end portion of said control shaft whereby said control shaft is manually rotated or longitudinally shifted, (h) link means operatively connecting the operator portion of said control shaft to said operator element, whereby rotation of said control shaft commensurately varies the speed of said frame, (i) first and second directional switches longitudinally spaced on said frame and operatively connected to said motor directional reversing means, and (j) a switch actuator member on said control shaft and between said first and second directional switches, whereby actuation of said first directional switch by said switch actuator member when said control shaft is moved in a first longitudinal direction actuates said reversing means for driving said frame in one longitudinal direction and actuation of said second directional switch by said switch actuator member when said control shaft moves in the opposite longitudinal direction actuates said reversing means to drive said frame in said other longitudinal direction.

2. The invention according to claim 1 further comprising electrical brake means for stopping said frame, a brake switch on said frame operatively connected to said brake means, a brake actuator mounted on said control shaft, said control shaft having a rotary stop position, whereby when said control shaft has been rotated to said stop position, said brake actuator energizes said brake switch to actuate said brake means to stop said frame.

3. The invention according to claim 2 in which said brake switch is operatively connected to said first and second directional switches so that when said brake switch is energized, said first and second directional switches are de-energized to de-energize said motor and interrupt the drive of said frame in either direction.

4. The invention according to claim 2 in which said brake actuator is an arm projecting radially from said control shaft and said brake switch is mounted in the rotary path of said brake arm for engagement by said arm to energize said brake switch.

5. The invention according to claim 1 in which each of said first and second directional switches comprises respectively first and second switch fingers longitudinally spaced apart a predetermined distance, and said switch actuator comprises an actuator lug fixed on said control shaft and having opposed faces, each face adapted to selectively engage said first or second switch finger, the distance between said switch faces being less than the distance between said switch fingers.

6. The invention according to claim 1 in which said motor is an electrical motor and said speed control device comprises an electrical variable voltage device fixed on said frame and having a rotary actuator shaft terminating in a driven gear for varying the voltage of said motor, said link means comprising a drive gear fixed concentrically upon said control shaft and meshing with said driven gear.

7. The invention according to claim 3 in which said second directional switch remains de-energized while said first directional switch is energized, regardless of the position of said control shaft, until said brake switch is energized, and said first directional switch remains de-energized while said second directional switch is energized, regardless of the position of said control shaft, until said brake switch is energized.

8. The invention according to claim 1 further comprising first and second automatic reversing switches mounted in longitudinally spaced relationship on said frame, each of said first and second reversing switches being actuable respectively by first and second actuating means spaced at opposite ends of the spreading surface, said first and second reversing switches being operatively connected to said first and second directional switches, whereby said first directional switch is de-energized by actuation of said first reversing switch at one end of said spreading surface and said second directional switch is de-energized by actuation of said second reversing switch at the opposite end of said spreading surface.

* * * * *